US011504681B2

(12) United States Patent
Kolb et al.

(10) Patent No.: US 11,504,681 B2
(45) Date of Patent: Nov. 22, 2022

(54) MICROFLUIDIC MIXING DEVICE AND METHOD

(71) Applicant: PerkinElmer Health Sciences, Inc., Waltham, MA (US)

(72) Inventors: Andrew Kolb, Seattle, WA (US); Matthew Scott Bragd, Redmond, WA (US); C. Frederick Battrell, Wenatchee, WA (US)

(73) Assignee: PERKINELMER HEALTH SCIENCES, INC., Waltham, MA (US)

( * ) Notice: Subject to any disclaimer, the term of this patent is extended or adjusted under 35 U.S.C. 154(b) by 1130 days.

(21) Appl. No.: 15/999,845

(22) PCT Filed: Feb. 17, 2017

(86) PCT No.: PCT/US2017/018268

§ 371 (c)(1),
(2) Date: Aug. 20, 2018

(87) PCT Pub. No.: WO2017/143120

PCT Pub. Date: Aug. 24, 2017

(65) Prior Publication Data

US 2021/0129097 A1 May 6, 2021

Related U.S. Application Data

(60) Provisional application No. 62/297,497, filed on Feb. 19, 2016.

(51) Int. Cl.
*B01F 33/30* (2022.01)
*B01F 31/65* (2022.01)

(52) U.S. Cl.
CPC ..... *B01F 33/30* (2022.01); *B01F 31/65* (2022.01)

(58) Field of Classification Search
CPC ..... B01F 33/30; B01F 31/65
See application file for complete search history.

(56) References Cited

U.S. PATENT DOCUMENTS 7,481,337 B2 1/2009 Luharuka et al.
2001/0048637 A1 12/2001 Weigl et al.
(Continued)

FOREIGN PATENT DOCUMENTS

CN 1326549 A 12/2001
CN 1898016 A 1/2007
(Continued)

OTHER PUBLICATIONS

Li, Jiaxing, et al. "Design and fabrication of microfluidic mixer from carbonyl iron-PDMS composite membrane." Microfluidics and nanofluidics 10.4 (2011): 919-925. (Year: 2011).*
(Continued)

*Primary Examiner* — Robert J Eom
(74) *Attorney, Agent, or Firm* — Seed Intellectual Property Law Group LLP

(57) ABSTRACT

A microfluidic mixing device comprising two bellows pumps (105, 115), microfluidic cartridges comprising the same and methods for use of the same are provided. The disclosed device enables efficient mixing of samples at the microfluidic scale. More particularly, the microfluidic mixing device comprises: a first bellows pump (105); a second bellows pump (115); a first microchannel fluidly interconnecting the first bellows pump (105) with a sample inlet and a reagent reservoir, wherein the first microchannel comprises a valve (V10) interposed between the pump and the inlet, and a valve (V1) interposed between the pump and the reservoir; a second microchannel fluidly interconnecting the first bellows pump (105) with the second bellows pump (115), wherein the second micro channel comprises a valve (V11) interposed between the first and second pump; a third microchannel fluidly interconnecting the first bellows pump (105) with the second bellows pump, wherein the third micro channel comprises a valve (V11) interposed between
(Continued)

100A the first and second pump; a first and second pneumatic member pneumatically connected to the first and second bellows pumps; wherein, the volume of the second bellows pump (115) is greater than the volume of the first bellows pump (105).

17 Claims, 8 Drawing Sheets

(56) References Cited

U.S. PATENT DOCUMENTS

| | | | | |
|---|---|---|---|---|
| 2002/0054835 | A1 | 5/2002 | Robotti et al. | |
| 2007/0183935 | A1 | 8/2007 | Clemmens et al. | |
| 2009/0148933 | A1* | 6/2009 | Battrell ..... | B01F 13/0059 435/287.2 |
| 2012/0136492 | A1 | 5/2012 | Amin et al. | |

FOREIGN PATENT DOCUMENTS

| | | | |
|---|---|---|---|
| CN | 101495236 | A | 7/2009 |
| CN | 101910415 | A | 12/2010 |
| CN | 103877919 | A | 6/2014 |
| CN | 104136123 | A | 11/2014 |
| JP | 2001-68496 | A | 3/2001 |
| JP | 2008-503722 | A | 2/2008 |
| JP | 2015-510111 | A | 4/2015 |
| WO | 2007/064635 | A1 | 6/2007 |
| WO | 2015/191916 | A1 | 12/2015 |

OTHER PUBLICATIONS

Liao, Chia-Sheng, et al. "Miniature RT-PCR system for diagnosis of RNA-based viruses." Nucleic Acids Research 33.18 (2005): e156-e156. (Year: 2005).*

* cited by examiner

200

300

400

400

MICROFLUIDIC MIXING DEVICE AND METHOD

FIELD OF THE INVENTION

The present invention relates generally to microfluidic devices for mixing fluidized biological samples and reagents for preparation, processing and/or analysis of the samples.

BACKGROUND OF THE INVENTION

Biological analytes of relevance to clinical, biological, or environmental testing frequently are found at low concentrations in complex fluid mixtures. It is important to capture, concentrate, and enrich the specific analyte away from background inhibitory or interfering matrix components that can limit the sensitivity and/or specificity of analyte detection assays. Specific analytes include but are not limited to nucleic acids, proteins, including for example antigens or antibodies, prokaryotic or eukaryotic cells, and viruses, and small molecules such as drugs and metabolites. Conventional sample preparation methods include centrifugation, solid phase capture, selective precipitation, filtration, and extraction. These methods are not generally amenable to efficient automation and integration with subsequent assay steps, especially in a manner compatible with the development of point of care testing.

Microfluidic devices have become popular in recent years for performing analytical testing. Using tools developed by the semiconductor industry to miniaturize electronics, it has become possible to fabricate intricate fluid systems that can be inexpensively mass-produced. Systems have been developed to perform a variety of analytical techniques for the acquisition and processing of information.

The ability to perform analyses microfluidically provides substantial advantages of throughput, reagent consumption, and automatability. Another advantage of microfluidic systems is the ability to integrate a plurality of different operations in a single "lap-on-a-chip" device for performing processing of reactants for analysis and/or synthesis. Microfluidic devices may be constructed in a multi-layer laminated structure wherein each layer has channels and structures fabricated from a laminate material to form microscale voids or channels where fluids flow. A microscale or microfluidic channel is conventionally defined as a fluid passage, which has at least one internal cross-sectional dimension that is less than 500 μm, and typically between about 0.1 μm and about 500 μm.

U.S. Pat. No. 5,716,852, hereby incorporated by reference in its entirety, is an example of a microfluidic device. The '852 patent teaches a microfluidic system for detecting the presence of analyte particles in a sample stream using a laminar flow channel having at least two input channels which provide an indicator stream and a sample stream, where the laminar flow channel has a depth sufficiently small to allow laminar flow of the streams and length sufficient to allow diffusion of particles of the analyte into the indicator stream to form a detection area, and having an outlet out of the channel to form a single mixed stream. This device, which is known as a T-Sensor, allows the movement of different fluidic layers next to each other within a channel without mixing other than by diffusion. A sample stream, such as whole blood, a receptor stream, such as an indicator solution, and a reference stream, which may be a known analyte standard, is introduced into a common microfluidic channel within the T-Sensor, and the streams flow next to each other until they exit the channel. Smaller particles, such as ions or small proteins, diffuse rapidly across the fluid boundaries, whereas larger molecules diffuse more slowly. Large particles, such as blood cells, show no significant diffusion within the time the two flow streams are in contact.

There is general agreement that, in the laminar flow regime characteristic of microfluidic channels, mixing is limited to diffusion. Because of the dimensions involved, wherein diffusional free path lengths are roughly equal the device dimensions, diffusional mixing can be very effective for solutes. This condition enables ribbon flow, T-sensor, and other useful microfluidic phenomena. However, for larger analytes such as cells, bacteria, viral particles, and for macromolecular complexes and linear polymers, diffusional mixing is slow and processes for capture or depletion of these species require prolonged incubation. Diffusional limits on mixing thus present a problem in microfluidic devices where bulk mixing or combination of a sample and reagents or beads is required. This problem has not been fully solved and methods, devices and apparatuses for improving the mixing arts are being actively sought.

SUMMARY OF THE DISCLOSURE

In brief, the present invention relates to microfluidic devices, apparatuses, and methods involving manipulating and mixing fluidized biological samples with reagents of different physical and chemical properties. In particular, disclosed microfluidic mixers utilize a plurality of microfluidic channels, vias, valves, pumps and other elements arranged in various configurations to manipulate the flow and mixing of fluid samples and reagents to prepare samples for subsequent analysis.

A preferred embodiment disclosed herein is a microfluidic mixing device, including a first bellows pump with a chamber bisected in coronal plane by a first elastomeric membrane, a second bellows pump with a chamber bisected in coronal plane by a second elastomeric membrane, a first microchannel fluidly interconnecting the first bellows pump with a sample inlet and a reagent reservoir, wherein the first microchannel comprises a valve interposed between the pump and the inlet and a valve interposed between the pump and the reservoir, a second microchannel fluidly interconnecting the first bellows pump with the second bellows pump, wherein the second micro channel comprises a valve interposed between the first and second pump, a third microchannel fluidly interconnecting the first bellows pump with the second bellows pump, wherein the third micro channel comprises a valve interposed between the first and second pump, a first and second pneumatic members pneumatically connected to the first and second bellows pumps; wherein, the volume of the second bellows pump is great than the volume of the first bellows pump. In certain embodiments, the first, second, and third microchannels intersect to form a web in fluid communication with the first bellows pump. In yet other embodiments, each of the channels of the microweb is in fluid communication with a liquid via. In yet another embodiment, each of the channels of the microweb is in fluid communication with a liquid via. In yet another embodiment, the microweb is configured to enable both laminar and turbulent fluid flow. In another embodiment, the second and third microfluidic channels comprise perpendicular extensions in fluid communication with the second bellows pump. In yet another embodiment, each of the extensions is in fluid communication with more than one via. In yet another embodiment, each of the extensions is in fluid communication with three vias. In another embodiment, the vias are configured to enable dispersed flow of liquid over substantially the entire surface area of the second bellows pump.

In another aspect, the invention provides a microfluidic cartridge including any of the mixing devices described herein.

In another aspect, the invention provides a method of processing serial aliquots of a test sample using any of the cartridges described herein.

DETAILED DESCRIPTION OF THE INVENTION

Figure 1A:
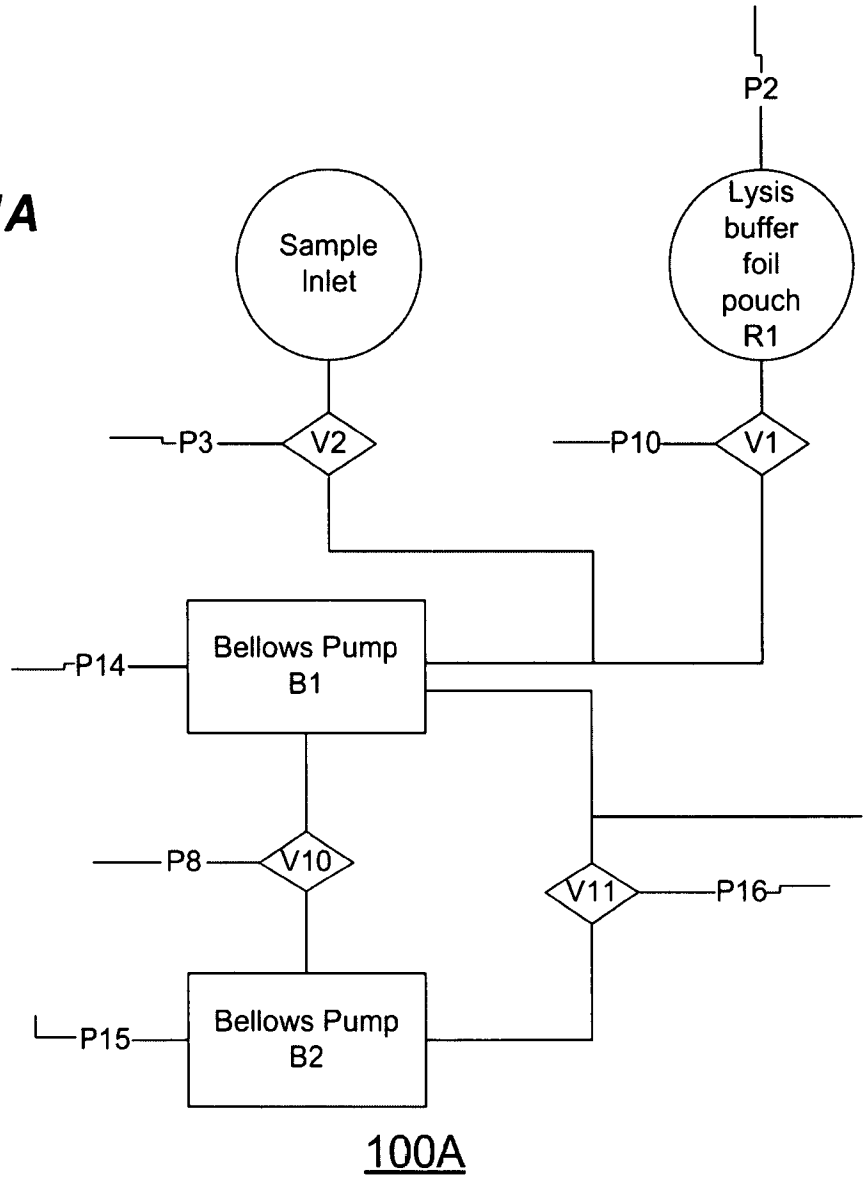
FIGS. 1A-1C illustrate sketches of alternative embodiments of the microfluidic mixers of the present invention.

As an aid in better explaining the invention, the following definitions are provided. If any definition provided herein is inconsistent with a dictionary meaning, meaning as commonly understood in the art, or meaning as incorporated by reference to a patent or literature citation, the definition presented here shall prevail.

Definitions

Microfluidic cartridge: a "device", "card", or "chip" with fluidic structures and internal channels having microfluidic dimensions. These fluidic structures may include chambers, valves, vents, vias, pumps, inlets, nipples, and detection means, for example. Generally, microfluidic channels are fluid passages having at least one internal cross-sectional dimension that is less than about 500 μm and typically between about 0.1 μm and about 500 μm. Therefore, as defined herein, microfluidic channels are fluid passages having at least one internal cross-sectional dimension that is less than 500 μm. The microfluidic flow regime is characterized by Poiseuille or "laminar" flow.

Bellows Pump: is a device formed as a cavity, often cylindrical in shape, bisected in coronal section by an elastomeric diaphragm to form a first and a second half-chamber which are not fluidically connected. The diaphragm is controlled by a pneumatic pulse generator connected to the first half-chamber. Positive pressure above the diaphragm distends it, displacing the contents of the second half-chamber, negative gauge pressure (suction) retracts it, expanding the second half chamber and drawing fluid in. By half-chamber, it should be understood that the effective area of the diaphragm is the lesser of the volume displacement under positive pressure and the volume displacement under suction pressure, and it thus optimal when the first and second half chambers are roughly symmetrical or equal in volume above and below the diaphragm. The second half-chamber is connected to a fluid in-port and out-port. The fluid in-port and out-port may be separate ports or a single port, but in either case, are under valve control. As described above, a pneumatic pulse generator is pneumatically connected to the first half-chamber, generally by a microchannel, which is also valved. In the complete apparatus, pneumatic actuation is programmable. Thus, programmable pneumatic pressure logic used by the pulse generator has two functions, to actuate the diaphragm on signal, and to open and close valves on signal. When the pulse generator is off-cartridge, nipples or inlets, a pneumatic manifold and solenoid valves are provided.

In use, fluid enters the second half-chamber of a bellows pump through the inlet valve when negative pressure is applied to the diaphragm (or passively, when fluid is pushed in by a second bellows pump). Then, when positive pressure is applied to the diaphragm, the fluid contents of the chamber are displaced out through the outlet valve. Similarly, positive and negative pressure signals control valve opening and closing. By supplying a train of positive and negative pressure pulses to a diaphragm, fluid can be moved in and out of a bellows pump chamber. This fluid motion becomes directional by the application of synchronized valve logic, thus the pumping action.

As disclosed here, pairs of bellows pumps, i.e., "dual bellows pumps", can mix suspensions of biological samples and reagents for sample preparation and/or analysis when configured with a first diaphragm pressure-actuated and a second diaphragm passive so as to force reciprocating flow between the two bellows chambers after the inlet and outlet valves are closed. Reciprocating flow can also be obtained by synchronously actuating both diaphragms with alternating or inverted pneumatic pulses. Similarly, a multiplicity of bellows pumps can be fluidly connected in series to perform a mixing function.

Test samples: Representative biological samples include, for example: blood, serum, plasma, buffy coat, saliva, wound exudates, pus, lung and other respiratory aspirates, nasal aspirates and washes, sinus drainage, bronchial lavage fluids, sputum, medial and inner ear aspirates, cyst aspirates, cerebral spinal fluid, stool, diarrhoeal fluid, urine, tears, mammary secretions, ovarian contents, ascites fluid, mucous, gastric fluid, gastrointestinal contents, urethral discharge, synovial fluid, peritoneal fluid, meconium, vaginal fluid or discharge, amniotic fluid, semen, penile discharge, or the like may be tested. Assay from swabs or lavages representative of mucosal secretions and epithelia are acceptable, for example mucosal swabs of the throat, tonsils, gingival, nasal passages, vagina, urethra, rectum, lower colon, and eyes, as are homogenates, lysates and digests of tissue specimens of all sorts. Mammalian cells are acceptable samples. Besides physiological fluids, samples of water, industrial discharges, food products, milk, air filtrates, and so forth are also test specimens. These include food, environmental and industrial samples. In some embodiments, test samples are placed directly in the device; in other embodiments, pre-analytical processing is contemplated. For example, fluidization of a generally solid sample is a process that can readily be accomplished off-cartridge.

Reagent: refers broadly to any chemical or biochemical agent used in a reaction, including enzymes. A reagent can include a single agent which itself can be monitored (e.g., a substance that is monitored as it is heated) or a mixture of two or more agents. A reagent may be living (e.g., a cell) or non-living. Exemplary reagents for a nucleic acid amplification reaction include, but are not limited to, buffer, metal ion (for example magnesium salt), chelator, polymerase, primer, template, nucleotide triphosphate, label, dye, nuclease inhibitor, and the like. Reagents for enzyme reactions include, for example, substrates, chromogens, cofactors, coupling enzymes, buffer, metal ions, inhibitors and activators. Not all reagents are reactants, tags, or ligands, and no reagents are target analytes.

Via: A step in a microfluidic channel that provides a fluid pathway from one substrate layer to another substrate layer above or below, characteristic of laminated devices built from layers.

Air ports: refer to the arms of a pneumatic manifold under programmable control of external servomechanisms. The pneumatic manifold may be charged with positive or negative gauge pressure. Operating pressures of +/−5 to 10 psig have been found to be satisfactory. Air and other gasses may be used.

"Conventional" is a term designating that which is known in the prior art to which this invention relates, particularly that which relates to microfluidic mixing devices.

"About", "around", "generally", and "roughly" are broadening expressions of inexactitude, describing a condition of being "more or less", approximately, or almost, where variations would be obvious, insignificant, or of lesser or equivalent utility or function, and further indicating the existence of obvious exceptions to a norm, rule or limit.

DETAILED DESCRIPTION OF THE FIGURES

As noted previously, embodiments of the present invention relate to microfluidic mixing devices, apparatuses, and methods utilizing a plurality of microfluidic channels, inlets, valves, membranes, pumps, liquid barriers and other elements arranged in various configurations to manipulate the flow of a fluid sample in order to prepare such sample for analysis and to analyze the fluid sample. In the following description, certain specific embodiments of the present devices and methods are set forth, however, persons skilled in the art will understand that the various embodiments and elements described below may be combined or modified without deviating from the spirit and scope of the invention.

FIG. 1A shows a schematic of a microfluidic mixing subcircuit 100A, for sample processing, of a microfluidic assay device, or cartridge, of the present invention. Sample, for example stool, urine, whole blood or plasma, can be fluid, solid or a mixture of both. In one embodiment, fluid sample is pipetted, or drawn, into a sample inlet, or liquid sample port. In another embodiment, sample is first fluidized and then introduced into a liquid sample port. In yet another embodiment, a swab having the material of interest is inserted into a chamber within the device; the neck of the swab is then broken off, and the device is sealed. Pretreatment is envisaged when necessary. For example, to remove vegetable, mucous, and unwanted particulate matter, fluidized sample is optionally pre-filtered through a depth filter, for example made of polypropylene fibers, and then mixed with lysis buffer, to release the target nucleic acid contents from associated debris and contaminants. Optionally, the prefilter may be used to separate the cellular and plasma components of blood.

Following introduction of the sample into the device, in the integrated devices of the invention, the remaining assay steps are automated or semi-automated.

Lysis buffer in the lysis buffer pouch contains, e.g., a chaotrope in combination with a detergent to effect cellular lysis and reduce associations between nucleic acids and adherent molecules, and optionally contains a nuclease inhibitor and chelator, such as EDTA to reduce nucleic acid degradation prior to wash.

We have found that guanidinium thiocyanate (GSCN), for example 4.5M GSCN, in combination with detergents such as sarcosine and Triton X-100, with weakly acidic buffer, successfully extract nucleic acids from stool that are suitable for PCR. This lysis buffer is also sufficient to remove hemoglobin from whole blood and lyse Gram negative bacteria.

However, mixing of the sample and the lysis buffer at the microscale requires ingenuity. Adaptation of biochemistry to microscale fluid assay devices has required novel engineering. In our experience, for example, a preferred mixing mechanism in the microfluidic devices of the present invention is to alternate fluid dynamics between laminar and turbulent flow. Motion in the laminar regime is characterized by parallel particle trajectories, and turbulent motion in transitional "puffs" represents strong mixing in the radial direction. Flow in conventional microfluidic structures is generally laminar and allows mixing by diffusion along boundary layers and interfaces. However, such phenomena present a problem in microfluidic devices in which bulk mixing, e.g. of solutions of different viscosities is required.

Embodiments of the present invention solve the problem of mixing solutions of different viscosities at the microscale by providing laminated or molded mixing devices including a pair of bellows pumps separated and connected by a circuit of flow-restricting channels. In this system, solutions moving through the channels experience laminar, focused flow. Upon exit from the channels into the chambers of the bellows pumps, the solutions form fluid "jets" and disperse as vortices in the bulk fluid of the chamber. These vortices, or "turbulent puffs" are characteristic of transition to turbulent flow. Turbulent mixing increases the surface area over which the solutions of different viscosities can interact and thus promotes and accelerates mixing of the two solutions. The increased surface area of the chambers relative to the channels also provides a platform enabling the faster moving, less viscous solution to contact the slower moving, more viscous solution. In the device, pneumatic actuators are provided so as to permit reciprocating flow of the two solutions between the two bellows pump chambers. Elastomeric membranes ensure forward and reverse isolation.

Operation of the microfluidic mixing subcircuit of FIG. 1A involves a series of steps based on pneumatic actuation of check valves and bellows pump to effect fluid transport and mixing. In a first step, sample is introduced into the sample inlet, valve V2 is opened, e.g., by applying suction pressure to the diaphragm of the valve, and bellows B1 draws the sample into the bellows as its diaphragm membrane is also lifted.

In a second step, valve V2 is closed, valve V10 is opened, bellows pump B1 pumps the sample into bellows pump B2 and valve V10 is closed. In an optional third step, sample is again introduced into the sample inlet, valve V2 is opened, and bellows pump B1 draws the sample into the bellows. In an optional forth step, valve V2 is closed, valve V10 is opened bellows pump B1 draws the sample into bellows pump B2 and valve V10 is closed.

In a fifth step, valve V1 is opened, valve V11 is opened and lysis buffer is introduced into bellows pump B2 after traversing bellows B1.

In a sixth step, valve V1 is closed, valve V10 is closed, bellows pump B2 pushes lysis buffer and sample through channels and valve V11 to bellows pump B1; valve V11 is closed, valve V10 is opened, bellows pump B1 pushes the mixture through channels and valve V10 to bellows pump B2. Step six is repeated multiple times to effectively mix the two samples as they flow through the circuit formed by the channels and bellows pumps. While in the channels, fluid flow is laminar; however, upon entry into the bellows chambers, fluid flow is turbulent. This repeated cycling of laminar flow in microchannels and turbulent flow in bellows chambers is surprisingly effective in mixing solutions of different viscosities, e.g., a biological sample and a lysis buffer based on chaotropes, such as guanidinium.

One advantageous feature of the microfluidic mixing subcircuits of the present invention is that they enable serial aliquots of a sample to be introduced into the mixing device, as discussed above. This functionality is achieved by designing the two pumps such that bellows pump B2 is larger in size, and thus accommodates a greater volume, than bellows pump B1. The ability of this mixing device to process serial aliquots of a single sample as well as to optionally bypass either of the pumps during operation provides advantageous flexibility to the user of the system, e.g. to customize a particular assay as required.

Figure 1B:
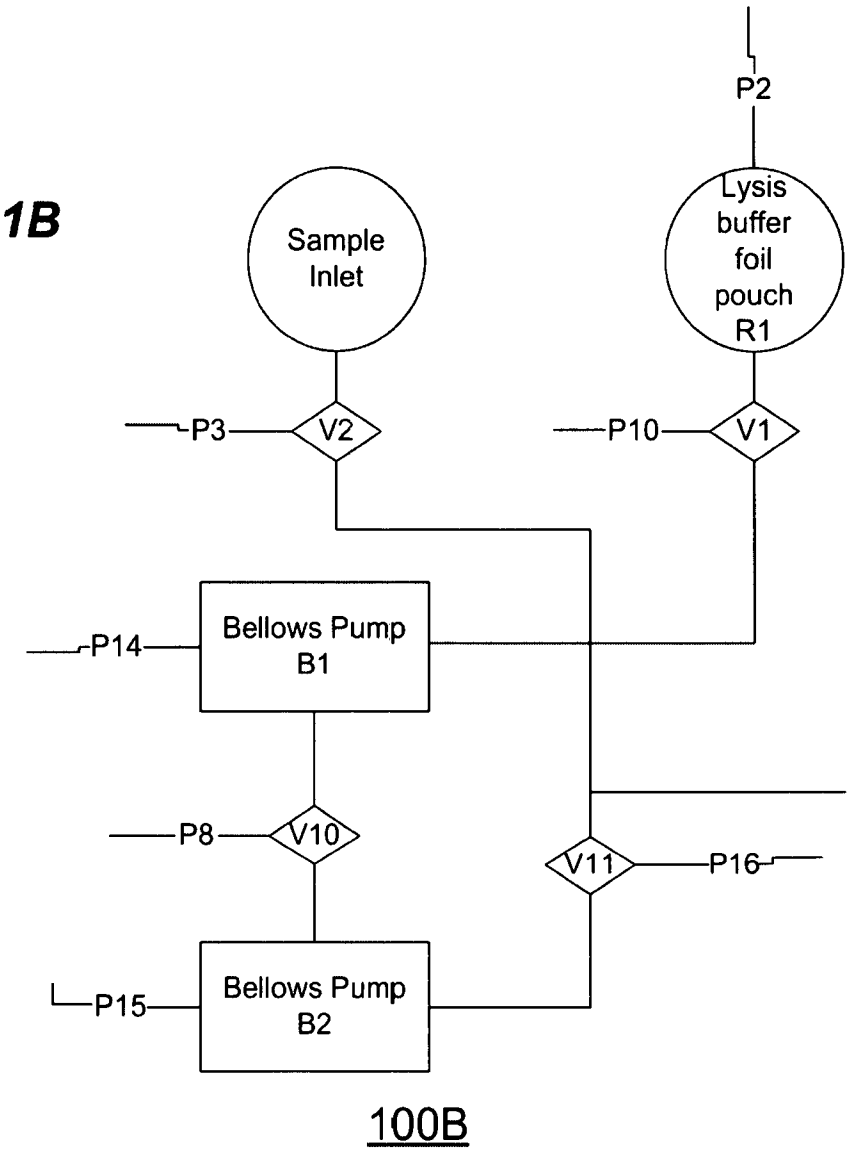

FIG. 1B is a schematic of an alternative embodiment of the present invention. Here microfluidic mixing subcircuit 100B for sample processing is configured as in FIG. 1A except that the lysis buffer reservoir is in direct fluidic communication with both bellows pumps B1 and B2. It is to be understood that several alternative configurations of channels, pumps, sample inlets and buffer reservoirs are able to achieve alternating laminar and turbulent mixing of solutions of different viscosities and are thus contemplated by the present invention.

Figure 1C:
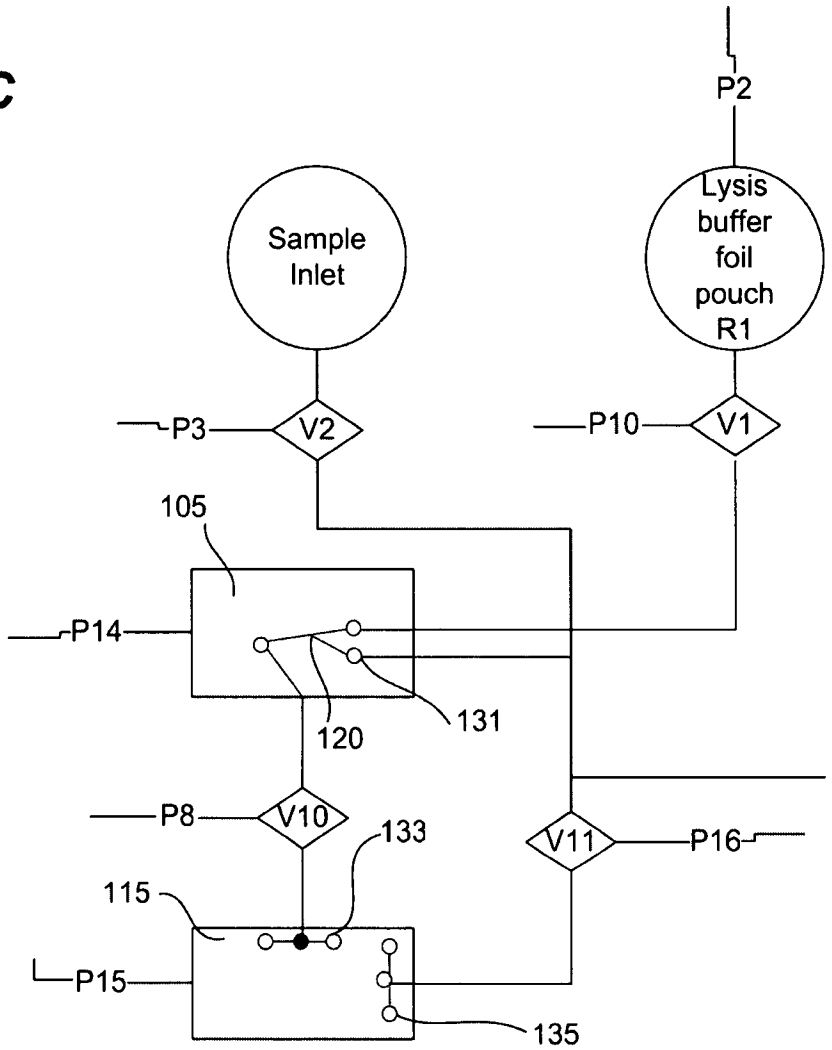

FIG. 1C is a schematic of an alternative embodiment of the present invention. Here microfluidic mixing subcircuit 100C for sample processing is configured as in FIG. 1A. This illustration depicts the interior fluidic works of bellows pumps, 105 and 115. In this embodiment, the smaller bellows pump 105 is in fluid connection with three microchannels that intersect to form a microchannel web. Each channel is in fluid connection with a via 131 that functions as a fluid inlet and/or outlet and enables fluid to enter and/or exit the channels and bellows pump. The three vias are additionally in fluid contact with each other through microchannel web 120. Microchannel web 120 advantageously enables mixing of fluids by both laminar flow within channels and turbulence as fluid streams collide at the junction of the three channels within the web. In addition, turbulent mixing continues as the fluids exit vias 131 and enter the chamber of the pump. It is to be understood that other suitable microchannel web configurations are contemplating by the present invention. For example, bellows pump 105 may be configured with from two to around ten vias all interconnect by a microchannel web.

Turning to large bellows pump 115, in this embodiment, each of the channels connected to the pump is extended in the perpendicular direction so that multiple vias can spread the flow of liquid entering the chamber of the pump. In the exemplary configuration depicted in FIG. 1C, the channel connecting valve V10 to pump 115 is expanded in the perpendicular direction to terminate in three vias, 133. Likewise, the channel connecting valve V11 with the pump is expanded in the perpendicular direction to terminate in three vias 135 (for simplicity of illustration, only a single via is denoted in the figure). It is to be understood that other exemplary numbers of vias are contemplating by the present invention, for example, each microchannel may be expanded to introduce from around three to around ten vias in the chamber of bellows pump 115. We have found that the introduction of multiple vias into the chamber of the large bellows pump has the advantage of facilitating the flow of viscous solutions over a greater surface area of the chamber, i.e. filling the chamber in "waves" rather than "streams". This has been found to advantageously enhance the mixing with solutions of lower viscosity, e.g. the mixing of a chaotropic lysis buffer and liquid sample.

Figure 2:
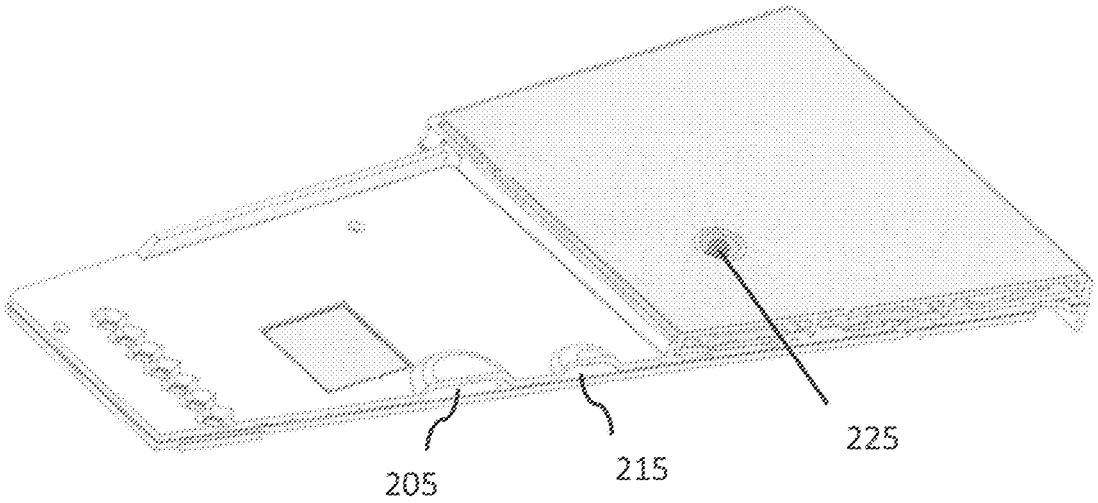
FIG. 2 is a-cross sectional view of one embodiment of the microfluidic cartridge of the present invention.

In FIG. 2, a microfluidic device, or cartridge, 200 is presented as a 3-dimensional CAD rendering with perspective. A cross-section through the device shows the cartridge fabricated by lamination of multiple layers. This embodiment requires two layers of solid molded plastic laminated together by an intermediary layer comprised of a laminate of double-sided adhesive on a thin plastic core (ACA). The intermediary layer provides the elastomeric membranes, or diaphragms, that form the valves and pumps of the device. The mixing device of the cartridge includes two bellows pumps: a larger bellows pump 205 and a smaller bellow pump 215. The two bellows pumps are fluidly connected by the network of microchannels and valves, as described with reference to FIGS. 1A-C. The cavities formed by the large and small bellows pumps are each bisected in coronal plane by an elastomeric diaphragm provided in the intermediary laminate layer. As discussed above, one advantage to providing a dual bellows pump mixing device in which a second pump is substantially larger than a first pump is the ability to introduce serial aliquots of a sample into the mixing subcircuit through sample inlet 225.

Figure 3:
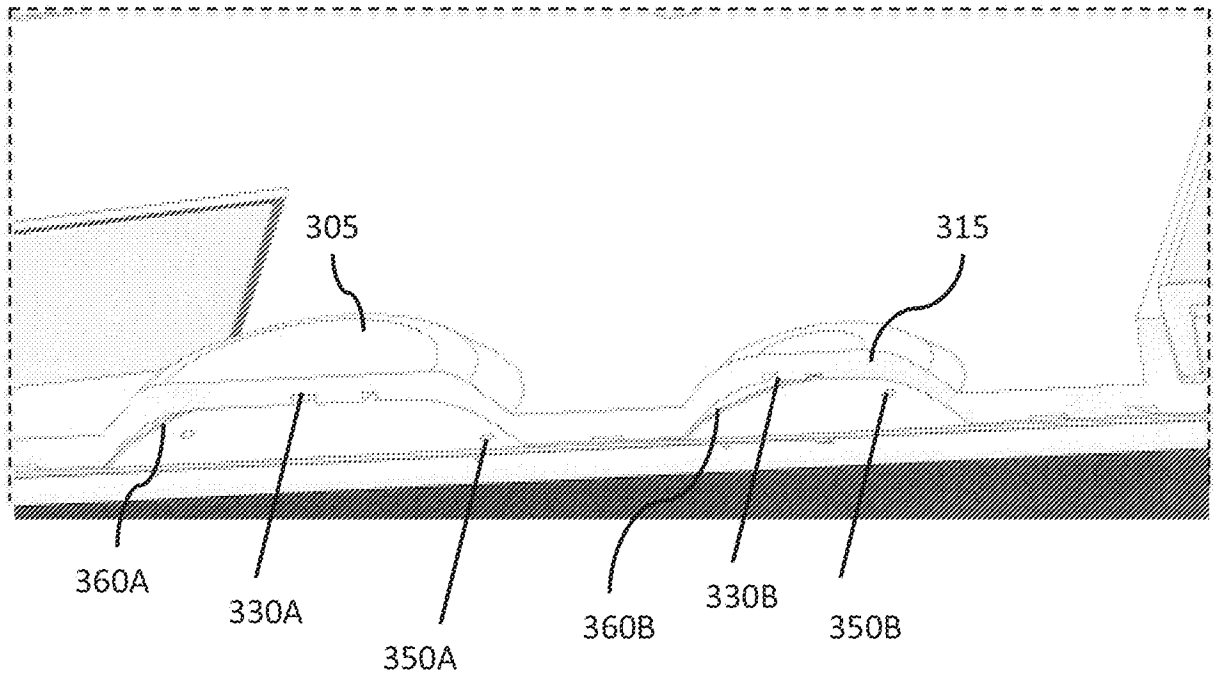
FIG. 3 is a detailed view of a-cross sectional view of one embodiment of the microfluidic mixer of the present invention.

The features of the bellows pumps of the microfluidic mixers of the present invention are shown in greater detail in FIG. 3, which is an expanded view of the pump configuration depicted in cross section in FIG. 2. Here, mixing device 300 includes two bellows pumps: a larger ("second") bellows pump 305 and a smaller ("first") bellow pump 315. The relative dimensions of the two pumps may be any value suitable to the specific assay of interest so long as the larger bellows pump is capable of retaining and mixing a greater volume than the smaller bellows pump. Generally, the height of the cavities formed by the two pumps will be substantially similar, to promote ease of insertion of the cartridge into a host instrument. However, in some embodiments, the height of the cavities formed by the two pumps may be different. Generally, the diameter of the larger bellows pump will be greater than the diameter of the smaller bellows pump. In some embodiments, the ratio of the diameter of the larger bellows pump to the diameter of the smaller bellows pump will be from around greater than one to around two. In other embodiments, the ratio of the diameter of the larger bellows pump to the diameter of the smaller bellows pump will be greater than two. In one exemplary embodiment, the height of each pump is around 3.15 mm, while the diameter of the larger bellows pump is around 22.5 mm and the diameter of the smaller bellows pump is around 15.5 mm. The operation of each pump is under pneumatic control of air channels fabricated in the upper molded body that terminate in vias 330A and 330B (for simplicity of illustration, only a single via is denoted in each pump) in pneumatic connection with the upper chambers of each bellows pump. Generally, each pump will have the same number of air vias. In some embodiments, each pump is pneumatically controlled by three vias each.

The two bellows pumps are fluidly connected by the network of microchannels, as described with reference to FIGS. 1A-C. Each microchannel is fluidly connected to the lower chamber of the bellows pumps by liquid vias, 350A and 350B (for simplicity of illustration, only a single via is denoted in each pump). As discussed with reference to FIG. 3C, each microchannel in fluid communication with the larger bellows pump 305 terminates in more than a single via. In an exemplary embodiment, the larger pump is in fluid communication with two channels that terminate in three vias each, such that fluid enters and/or exits the larger pump through six liquid vias. In another exemplary embodiment, the smaller bellows pump is fluidly connected to three microchannels that each terminate in a single liquid via, such that fluid enters and/or exits the smaller pump through three vias. It is to be understood that any other number of vias entering the larger and smaller pumps may be suitable for practice of the invention and will be determined by the specific application of interest. The cavities formed by the large and small bellows pumps are each bisected in coronal plane by the elastomeric diaphragms 360A and 360B, provided in the intermediary laminate layer.

Figure 4A:
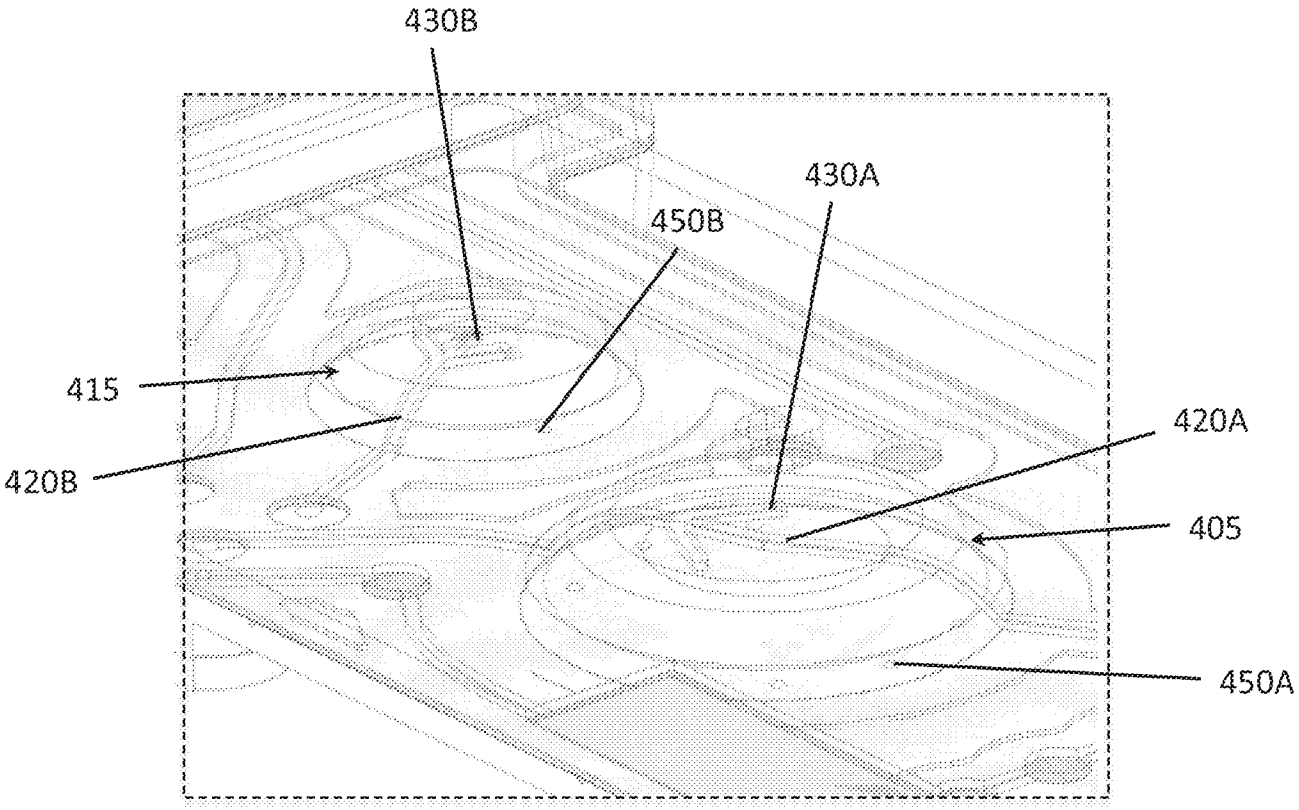
FIGS. 4A-4C are detailed sectional views of one embodiment of the microfluidic mixer of the present invention.

FIG. 4A depicts an embodiment 400 of the mixing device described with reference to FIG. 3 as a three-dimensional CAD drawing with transparent features to enable illustration of the layered structure of the device. Both the smaller bellows pump 415 and the larger bellows pump 405 are under pneumatic control of a single air channel, 420A and 420B, each. Each air channel terminates in three vias, 430A and 430B (for simplicity of illustration, only a single via is denoted in each pump), in pneumatic connection with the upper chamber of each pump. The lower chamber of smaller bellows pump 415 is in fluid communication with three liquid vias 450B, while the lower chamber of larger bellows pump 405 is in liquid communication with six liquid vias 450A (for simplicity of illustration, only a single via is denoted in each pump).

Figure 4B:
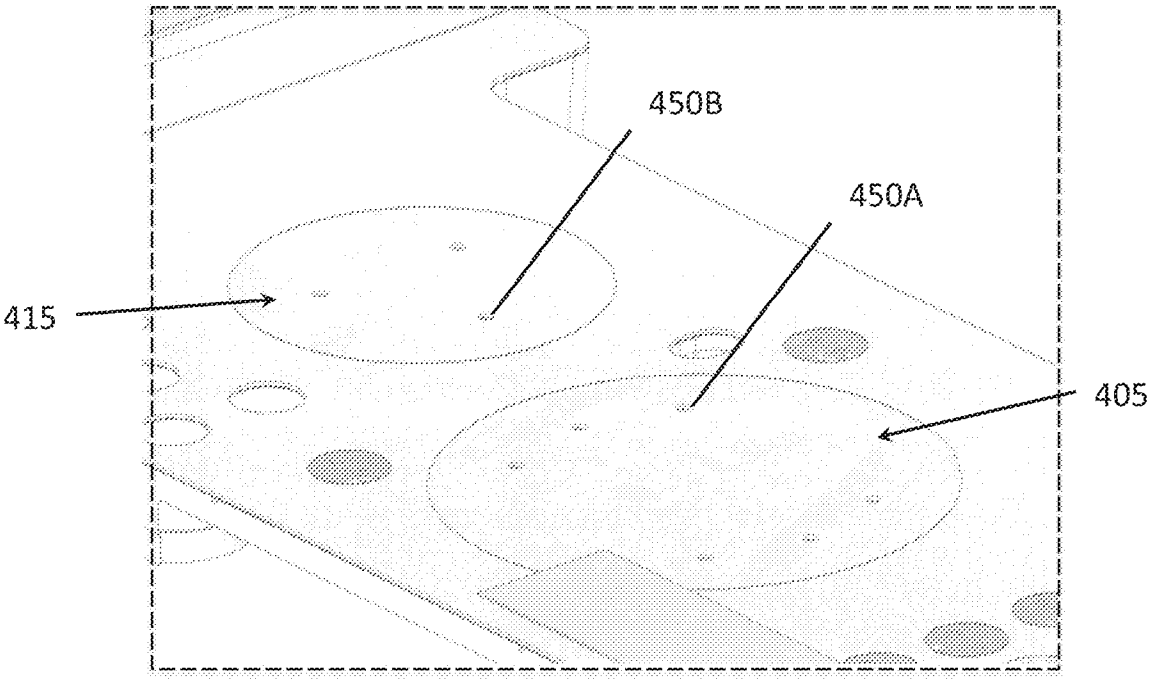

FIG. 4B shows a sectional view of mixing device 400, depicting the bottom surface of the interior chambers formed by larger bellows pump 405 and smaller bellows pump 415. As discussed with reference to FIG. 4A, larger pump 405 is in fluid connection with six liquid vias 450A, while smaller pump 415 is in fluid connection with three vias 450B. As discussed herein, the number and configuration of vias 450B has been found to advantageously facilitate the flow of viscous solutions over a greater surface area of the bottom of the larger pump, i.e. filling the chamber in "waves" rather than "streams", with the consequent enhanced mixing with solutions, e.g., of lower viscosity.

Figure 4C:
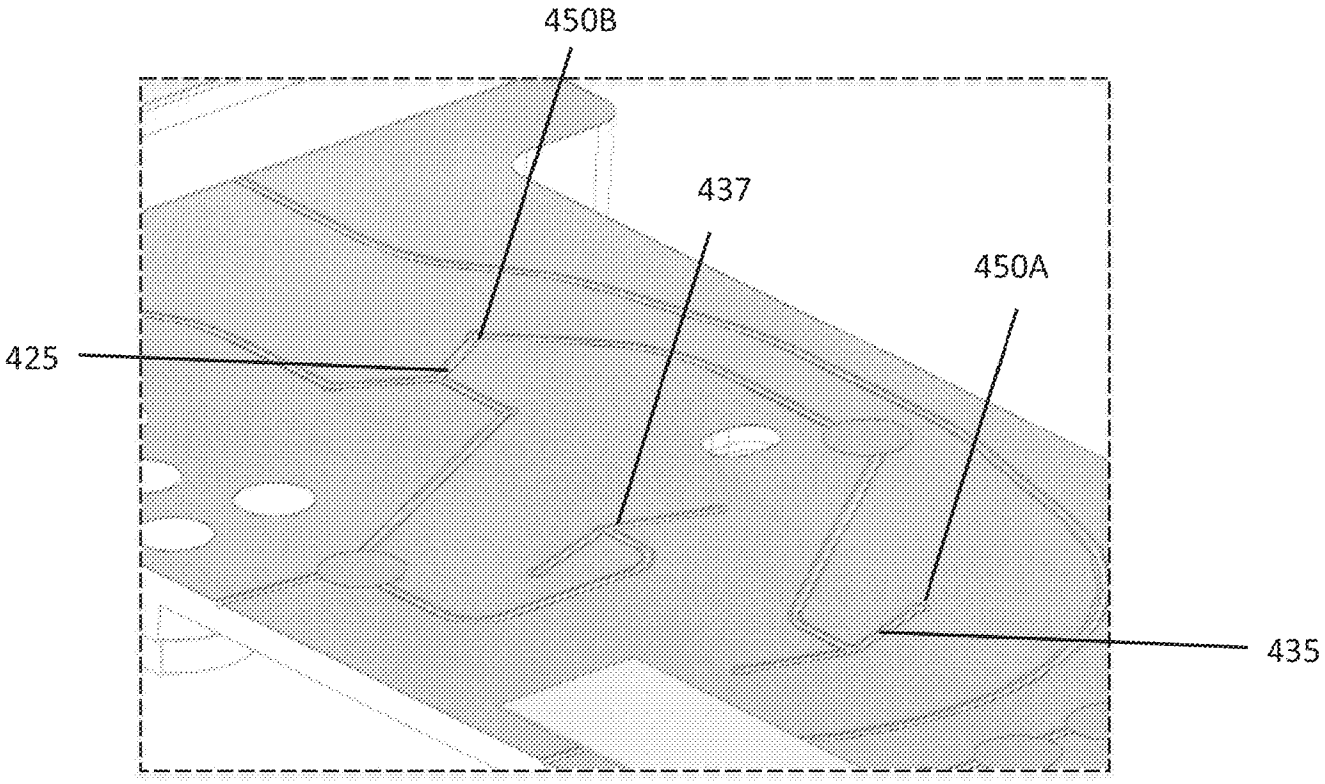

FIG. 4C shows a sectional view of mixing device 400, depicting the microfluidic channels formed in the layer below the section depicted in FIG. 4B. This view illustrates the microchannel web 425 formed by the two microchannels in fluid connection with the smaller bellows pump. The microchannel web 425 is in fluid communication with the three fluid vias 450B (for simplicity of illustration, only a single via is denoted) of the smaller bellows pump. As discussed herein, microchannel web 425 advantageously enables mixing of fluids by laminar flow within channels followed by turbulent mixing when the fluid streams collide at the junction of the three channels within the web of the smaller bellows pump. These alterations of laminar and turbulent flow have been found to enhance the rate of mixing of solutions with different physico-chemical properties, e.g. solutions with different viscosities. The two microchannels in fluid communication with the larger bellows pump each extend in the perpendicular direction to form extensions 435 and 437, which, in turn, are each in fluid communication with three vias, such that the larger bellows pump has six fluid vias to enable fluid flow into the chamber of the pump in "waves".

Embodiments of the invention include, but are not limited to, the following:

Embodiment 1. A microfluidic mixing device, comprising:

a first bellows pump with a chamber bisected in coronal plane by a first elastomeric membrane;

a second bellows pump with a chamber bisected in coronal plane by a second elastomeric membrane;

a first microchannel fluidly interconnecting the first bellows pump with a sample inlet and a reagent reservoir, wherein the first microchannel comprises a valve interposed between the pump and the inlet and a valve interposed between the pump and the reservoir;

a second microchannel fluidly interconnecting the first bellows pump with the second bellows pump, wherein the second micro channel comprises a valve interposed between the first and second pump;

a third microchannel fluidly interconnecting the first bellows pump with the second bellows pump, wherein the third micro channel comprises a valve interposed between the first and second pump; and a first and second pneumatic member pneumatically connected to the first and second bellows pumps;

wherein, the volume of the second bellows pump is greater than the volume of the first bellows pump.

Embodiment 2. The microfluidic mixing device of embodiment 1, wherein the first, second, and third microchannels intersect to form a web in fluid communication with the first bellows pump.

Embodiment 3. The microfluidic mixing device of embodiment 2, wherein each of the channels of the web is in fluid communication with a liquid via.

Embodiment 4. The microfluidic mixing device of embodiment 2, wherein the web is configured to enable both laminar and turbulent fluid flow.

Embodiment 5. The microfluidic mixing device of embodiment 1, wherein the second and third microfluidic channels comprise perpendicular extensions in fluid communication with the second bellows pump.

Embodiment 6. The microfluidic mixing device of embodiment 5, wherein each of the extensions is in fluid communication with more than one via.

Embodiment 7. The microfluidic mixing device of embodiment 6, wherein each of the extensions is in fluid communication with three vias.

Embodiment 8. The microfluidic mixing device of embodiment 6, wherein the vias are configured to enable dispersed flow of liquid over substantially the entire surface area of the second bellows pump.

Embodiment 9. A microfluidic cartridge comprising the mixing device of any one of embodiments 1-8.

Embodiment 10. A method of processing serial aliquots of a test sample using the cartridge of embodiment 9, the method comprising:

introducing a first aliquot of the test sample into the sample inlet;

drawing the first aliquot into the first bellows pump;

drawing the first aliquot from the first bellows pump to the second bellows pump;

introducing a second aliquot of the test sample into the sample inlet;

drawing the second aliquot into the first bellows pump; and drawing the second aliquot from the first bellows pump to the second bellows pump.

The various embodiments described above can be combined to provide further embodiments. U.S. Provisional Application 62/297,497, filed Feb. 19, 2016 is incorporated herein by reference, in its entirety. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A microfluidic mixing device, comprising:

a first bellows pump with a chamber bisected in coronal plane by a first elastomeric membrane;

a second bellows pump with a chamber bisected in coronal plane by a second elastomeric membrane;

a first microchannel fluidly interconnecting the first bellows pump with a sample inlet and a reagent reservoir, wherein the first microchannel comprises a valve interposed between the first bellows pump and the inlet and a valve interposed between the first bellows pump and the reservoir;

a second microchannel fluidly interconnecting the first bellows pump with the second bellows pump, wherein the second microchannel comprises a valve interposed between the first and second bellows pumps;

a third microchannel fluidly interconnecting the first bellows pump with the second bellows pump, wherein the third microchannel comprises a valve interposed between the first and second bellows pumps;

a first and second pneumatic member pneumatically connected to the first and second bellows pumps;

wherein, the volume of the second bellows pump is greater than the volume of the first bellows pump.

2. The microfluidic mixing device of claim 1, wherein the first, second, and third microchannels intersect to form a web in fluid communication with the first bellows pump.

3. The microfluidic mixing device of claim 2, wherein each of the microchannels of the web is in fluid communication with a liquid via.

4. The microfluidic mixing device of claim 2, wherein the web is configured to enable both laminar and turbulent fluid flow.

5. The microfluidic mixing device of claim 1, wherein the second and third microchannels comprise perpendicular extensions in fluid communication with the second bellows pump.

6. The microfluidic mixing device of claim 5, wherein each of the extensions is in fluid communication with more than one via.

7. The microfluidic mixing device of claim 6, wherein each of the extensions is in fluid communication with three vias.

8. The microfluidic mixing device of claim 6, wherein the vias are configured to enable dispersed flow of liquid over substantially the entire surface area of the second bellows pump.

9. The microfluidic mixing device of claim 1 wherein heights of cavities of the first and second bellows pumps are the same.

10. The microfluidic mixing device of claim 1 wherein heights of cavities of the first and second bellows pumps are different.

11. The microfluidic mixing device of claim 1 wherein diameters of cavities of the first and second bellows pumps are different.

12. The microfluidic mixing device of claim 1 wherein a ratio of a second diameter of the second bellows pump to a first diameter of the first bellows pump is between one and two.

13. The microfluidic mixing device of claim 1 wherein a ratio of a second diameter of the second bellows pump to a first diameter of the first bellows pump is greater than two.

14. The microfluidic mixing device of claim 1 wherein the first microchannel is fluidly connected to a lower chamber of the first bellows pump, the second microchannel is fluidly connected to the lower chamber of the first bellows pump and to a lower chamber of the second bellows pump, and the third microchannel is fluidly connected to the lower chamber of the first bellows pump and to the lower chamber of the second bellows pump.

15. The microfluidic mixing device of claim 1 wherein the first microchannel is fluidly connected to a lower chamber of the first bellows pump by a first via, the second microchannel is fluidly connected to the lower chamber of the first bellows pump by a second via and to a lower chamber of the second bellows pump by a third via, and the third microchannel is fluidly connected to the lower chamber of the first bellows pump by a fourth via and to the lower chamber of the second bellows pump by a fifth via.

16. A microfluidic cartridge comprising the mixing device of claim 1.

17. A method of processing serial aliquots of a test sample using the cartridge of claim 16, the method comprising:

introducing a first aliquot of the test sample into the sample inlet;

drawing the first aliquot into the first bellows pump;

drawing the first aliquot from the first bellows pump to the second bellows pump;

introducing a second aliquot of the test sample into the sample inlet;

drawing the second aliquot into the first bellows pump; and drawing the second aliquot from the first bellows pump to the second bellows pump.

* * * * *